US005331530A

United States Patent [19]

Scholz

[11] Patent Number: 5,331,530

[45] Date of Patent: Jul. 19, 1994

[54] OPERATING THEATRE LAMP

[76] Inventor: Manfred Scholz, Im Täle 3, Seitingen-Oberflacht, Fed. Rep. of Germany

[21] Appl. No.: 983,430

[22] Filed: Dec. 2, 1992

[30] Foreign Application Priority Data

Dec. 6, 1991 [DE] Fed. Rep. of Germany ..... 4140325

[51] Int. Cl.[5] ..... F21V 7/00

[52] U.S. Cl. ..... 362/293; 362/298; 362/302; 362/346; 362/804

[58] Field of Search ..... 362/293, 298, 302, 304, 362/804, 346

[56] References Cited

U.S. PATENT DOCUMENTS

| | | | |
|---|---|---|---|
| 950,600 | 3/1910 | Perry | 362/298 |
| 1,822,076 | 9/1931 | Bauersfeld . | |
| 2,173,325 | 9/1939 | Alexander . | |
| 4,395,750 | 7/1983 | Scheidemann et al. | 362/298 |
| 4,937,714 | 6/1990 | Witt | 362/804 |
| 5,178,452 | 1/1993 | Scholz | 362/804 |

FOREIGN PATENT DOCUMENTS

| | | |
|---|---|---|
| 3633609A1 | 4/1987 | Fed. Rep. of Germany . |
| 974128 | 2/1951 | France . |
| 825638 | 12/1959 | United Kingdom . |
| 1517357 | 7/1978 | United Kingdom . |

*Primary Examiner*—Richard R. Cole
*Attorney, Agent, or Firm*—Townsend and Townsend Khourie and Crew

[57] ABSTRACT

An operating theatre lamp comprises a housing provided at the bottom with a light outlet opening (12) and in which a light source (13) is centrally arranged. The light source emits light all around toward a main ring concave reflector (14) which is mounted in the housing and deflects the incident light rays towards the light outlet opening (12) and concentrates them on a site of operation (15). At least one auxiliary ring reflector (17, 18) is provided between the light source (13) and the main reflector (14) outside of the light rays extending from the light source (13) toward the main reflector (14) which receives the light rays which would normally pass at the side of the main reflector (14) and deflects them toward locations of the main reflector (14) at which they are deflected toward the site of operation. In accordance with the invention, the auxiliary reflectors (17, 18) arranged above and below the light rays (16) deflect the incoming light from the light source (13) substantially back toward the light source (13) or past the latter to the diametrically oppositely lying region of the main reflector (14) on the opposite side of the light source (13).

17 Claims, 1 Drawing Sheet

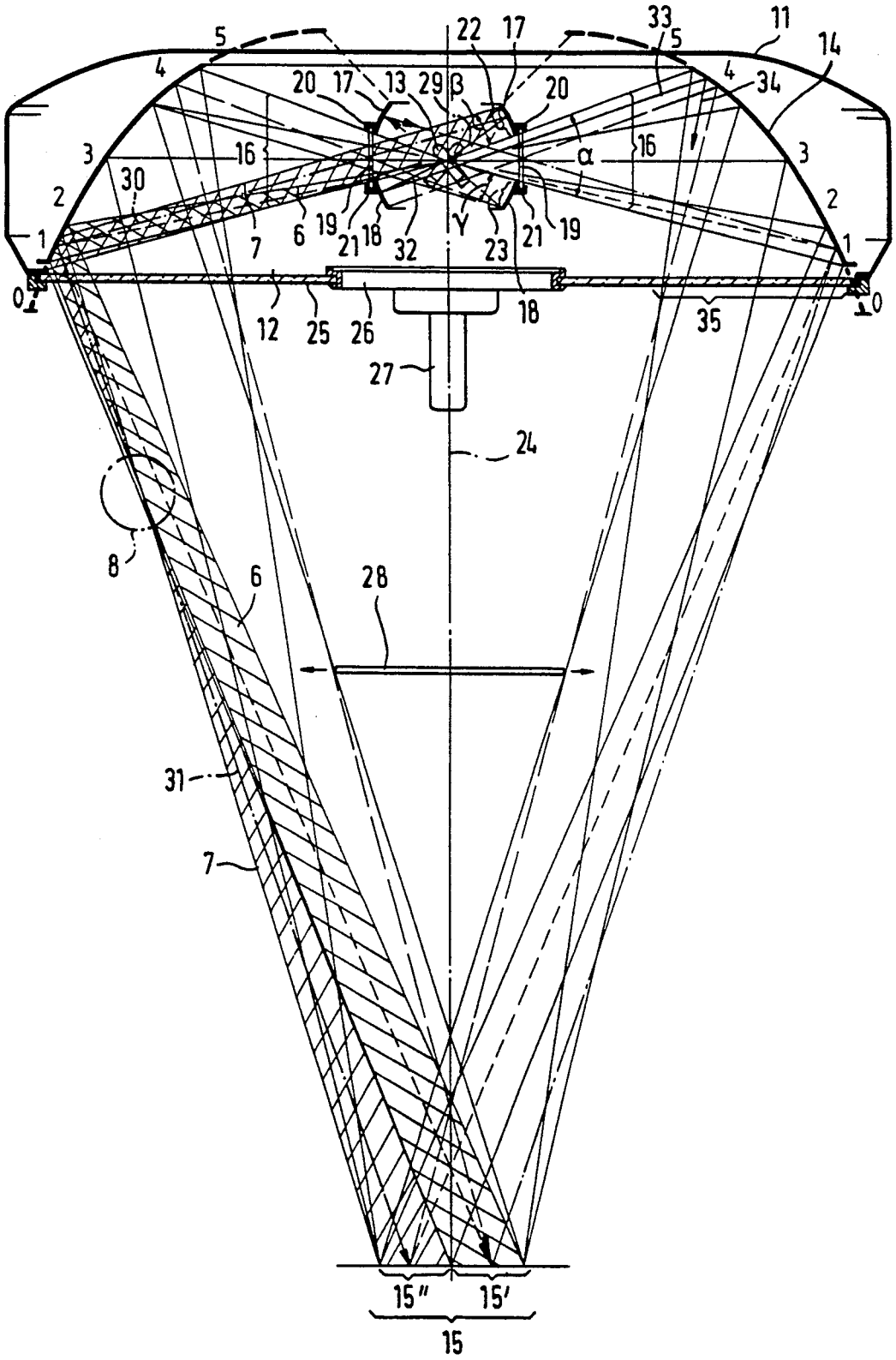
5
22
17
33
5
11
14
4
20
17
13
29
β
20
4
34
3
16
α
16
3
30
2
2
1
1
7
6
19
21
18
32
γ
23
21
19
0
12
25
26
18
35
0
27
24
8
6
28
31
7
15″
15′
15

OPERATING THEATRE LAMP

BACKGROUND OF THE INVENTION

The present invention relates to an operating theatre lamp comprising a housing provided at the bottom with a light outlet opening, a light source is centrally arranged in the housing and emits light all around towards a main ring concave reflector mounted in the housing. The main reflector deflects the incident light rays towards the light outlet opening and concentrates these light rays on a site of operation. At least one auxiliary ring reflector is provided between the light source and the main reflector outside of the light rays propagating from the light source to the main reflector. The auxiliary reflector receives the light rays which would normally pass to the side of the main reflector and deflects them toward locations of the main reflector at which they are deflected toward the site of operation.

Operating theatre lamps serve to illuminate the site of an operation opened by a surgeon in a patient. In this case it is important that the illumination be bright and regular, also permitting the surgeon to recognize minute tissular differences owing to a high colour fidelity and ensuring a far-reaching absence of shadows. The light rays must arrive onto the site of operation not only perpendicularly, but they must also include at least in part important components coming from the side in order that largely vertical walls of deep wounds can also be sufficiently illuminated. The main reflectors of such operating theatre lamps are therefore designed in such a way that they emit a mixture of light falling practically perpendicular onto the site of operation with obliquely falling light. Far-reaching absence of shadows signifies that apparatus or the hands and the head of the surgeon brought into the light bundle do not give rise to shadows in the site of operation which would disturb the observation.

In the prior art one can find one-eyed lamps operating with a large parabolic annular reflector, in particular a polygonal reflector, as well as so-called multi-eyed lamps which comprise several individual lamps arranged on the underside of the lamp body. The invention is concerned with one-eyed operating theatre lamps, wherein the central light source can nevertheless also be realized by means of two lamps or more in close propinquity. The light source lies at the center of the main reflector, from which the light rays extend all around in straight lines toward the main reflector.

It is however, also possible that one or several light sources emit the light from above onto a ring reflector concentrically arranged in the housing, this reflector deflects the light rays laterally toward the main reflector (DE-OS 36 33 609; GB-PS 1 517 357). Further, an operating theatre lamp which ensures an illumination of a site of operation practically without cast shadows is already known (GB-PS 825 638), in which the normally lost light rays of the light source are deflected toward the main reflector by means of an auxiliary reflector arranged above the light rays which extend toward the main reflector. The advantage of providing an upper auxiliary reflector resides in that the housing can be made narrower in vertical direction, i.e. more compact than when using a main reflector having a greater extension. A problem with such a configuration is a larger distance from the apparent interception point of the imaginary extensions of the rays of the auxiliary reflector with the center of the main reflector. In the known solution it is therefore not possible to simultaneously overlay direct lamp light and light coming from the auxiliary reflector in regions of the main reflector. Therefore it is not possible to achieve the required compact construction with the required absence of cast shadows and regular illumination.

The object of the invention is to realize a further operating theatre lamp of the kind mentioned at the beginning.

In order to solve this problem, the invention provides that the auxiliary reflector(s) arranged above and/or below the light rays propagating from the light source to the main reflector. The auxiliary reflector(s) deflect the incoming light from the light source substantially back toward the light source or past the latter to the region of the main reflector which is at least substantially diametrically oppositely disposed on the opposite side of the light source.

Thus, according to the invention, the light which would otherwise be lost is not deflected to the side of the main reflector on which the reflecting location of the auxiliary reflector is placed, but precisely to the diametrically opposite side. This firstly provides the advantage that the auxiliary reflector or reflectors are not impinged on under a flat angle but at least approximately perpendicular by the light of the light source, such that despite the interception of larger angular ranges of emitted light the width of the auxiliary reflector or reflectors can be kept low. Further, by appropriate inclination of the reflecting regions of the auxiliary reflectors, the reflected light can be deflected in this manner in an ideal manner onto such regions of the main reflector from which this light not only arrives on the site of operation but also illuminates the latter in a regular manner.

In order to keep the width of the auxiliary reflector or reflectors as low as possible, the auxiliary reflectors are provided as close as possible to the light source, under consideration of the heating by the light source, and/or substantially on the same radius as a filter arranged all around the light source.

When appropriately dimensioning the main reflector and the auxiliary reflectors it is possible to achieve that the light lost in the site of operation because of a cutaway region of the main reflector is precisely completed again at the same place by the light intercepted by the auxiliary reflector. Therefore, despite the saving of surfaces at the outer periphery of the main reflector one obtains in a far-reaching manner the same illumination of the site of operation as with a larger main reflector.

According to a further embodiment a filter cylinder held on the housing by means of upper and lower fixtures is arranged around the light source. The filter cylinder is located in the radiation path to the main reflector and the auxiliary reflector or reflectors are secured at the top and/or the bottom on the fixtures.

Owing to these features, it is also possible to use for the mounting of the auxiliary reflectors the same mountings which are provided for the filter. The filter cylinder generally serves to filter the heat issuing from the light source and also optionally the UV radiation.

A further important affect is that the radially further outwardly-lying regions of the main reflector, at which prevails otherwise the lowest light intensity because of the relatively important distance from the light source, are additionally subjected with light, which leads to a constant illumination of the site of operation on shadowing out by persons.

In order to be able to also reduce the diameter of the main reflector, it is advantageous to provide both an upper and a lower auxiliary reflector. In this way it is possible to cut away the lower regions located radially mostly outwardly in a conventional main reflector, such that a lower diameter of the lamp is achieved. The light which is lost in this manner is deflected by the lower auxiliary reflector toward radially further inwardly disposed regions of the main reflector, in particular in its upper region, such that this light is not lost.

Owing to the features of the invention it is thus possible to reduce both the height and the diameter of the operation theatre lamp without reducing illumination of the site of operation. The diameter reduction is indeed comparably low but results in the laminar air flow usually provided in operation rooms from the top toward the bottom is significantly less affected than by a known operation theatre lamp having a somewhat larger diameter with a same light intensity and a same illumination of the site of operation. Indeed, the cross-section of the lamp reduces as a function of the square of the radius.

BRIEF DESCRIPTION OF THE DRAWINGS

The FIGURE shows a central vertical cross-section of an operation theatre lamp in accordance with the invention.

As shown in the FIGURE, a main ring concave reflector 14 is arranged concentrically to the main axis 24 in a flat housing 11 which is circular with respect to the middle axis 24. A substantially point-like light source 13 is arranged at the center of the main reflector. In the illustrated exemplary embodiment, this light source is realized by two halogen lamps arranged close to each other and at an angle of about 90°. A filter cylinder 19 is arranged concentrically about the middle axis 24 all around the light source 13. The axial height of the filter is so large that the light extending in a sector 16 from the light source 13 toward the main reflector 14 is entirely intercepted by the filter cylinder 19. The filter cylinder 19 filters in particular the infrared components from the light of the light source 13.

The main reflector 14 deflects the light rays incoming from the sectors 16 downwardly toward a light outlet opening 12 in the housing 1, which is covered up by a transparent ring disk 25, which preferably scatters the light irregularly and is held at the center by means of a center plate 26. A handle 27 for the displacements of the lamp is provided at the bottom of the center plate concentrically to the middle axis 24.

The filter cylinder 19 is held at the top and the bottom by means of ring-shaped fixtures 20, 21 secured to the housing 11 in a manner not shown. Upper and lower auxiliary ring reflectors 17, 18, concentric to the middle axis 24, are additionally secured to the fixtures 20, 21.

The arrangement and the structure of the reflectors 14, 17, 18 results in detail from the following functional description:

The light emitted by the light source 13 all around within the light sectors 16 having an angle $\alpha$ is concentrated by the main reflector 14 on a site of operation 15, and indeed in such a manner that the light bundle impinging onto a respective sector region 1, 2, 3 or 4 illuminates by itself the site of operation 15 in a largely regular manner. One obtains in this manner that an apparatus brought below the lamp, for example at 28, does not produce any shadow in the site of operation 15, and even if the apparatus is displaced somewhat toward the left or the right in the direction of the arrows from the position shown in the drawing.

In order to also intercept the light which would otherwise go past the main reflector 14, light sectors 22, 23 which respectively have an angle $\beta$ or $\gamma$ are located at the top and the bottom in continuation of the sectors 16 having an angle $\alpha$, and the auxiliary reflectors 17, 18 are positioned in the region of these light sectors 22, 23. The light sectors 16, 22 on the one hand and 16, 23 on the other hand are directly mutually adjacent.

The auxiliary reflectors 17, 18 are inclined relative to the middle axis 24 and incurved in the manner of concave mirrors in such a way that the incident light on a given location is reflected back in the direction of the light source 13 or as close as possible past the latter, such that it still impinges onto the location of the main reflector 14 which lies diametrically opposite with respect to the reflection location on the auxiliary reflector 17, and this on the border which lies on the other side of the light source 13 relative to the reflecting reflector 17 or 18 when considered axially.

In this way, a light ray 29 issuing from the light source 13 is reflected on the upper auxiliary reflector 17 in such a manner that it arrives as a reflection ray 30 past the light source 13 to the lower region 1 of the main reflector 14, wherefrom it arrives then to the site of operation 15 as a ray 31 deflected a second time. By appropriately inclining and realizing the auxiliary reflector 17 one can obtain that the light intercepted by this auxiliary reflector 17 illuminates the site of operation 15 exactly in the same manner as a main reflector 14 having a somewhat larger diameter, i.e. a reflector which is enlarged by a further region 0 indicated in broken lines in the drawing. Owing to the feature of the invention it is therefore possible to obtain a far-reaching corresponding result by means of a main reflector 14 having a smaller diameter.

The lower auxiliary reflector 18 intercepts the light emitted by the light source 13 in the sector 23 and an angle $\gamma$ which would otherwise have reached the region 0, indicated in broken lines and in fact not provided for, of a main reflector 14 having a somewhat larger diameter. This light is now (see for example the light ray 32) reflected by the auxiliary reflector 18 as a light ray 33 to the upper region 4 of the main reflector, wherefrom it arrives then to the site of operation as a light ray 34 deflected a second time.

Owing to the auxiliary reflector or reflectors 17, respectively 18, one further obtains that the intensity of the light beam in the annular region 35 is increased.

At the top of the drawing is also indicated in broken lines an extended region 5 of the main reflector 14, which would have to be present if the light intercepted by the upper auxiliary reflector 17 had to be deflected by the main reflector 14 toward the site of operation. However, in accordance with the invention, this region can be dispensed with, whereby it is possible to substantially reduce the height of the housing 11. The decisive advantage of the replacement of the region 5 by the upper auxiliary reflector 17 resides however in that the light intercepted by the auxiliary reflector 17 is deflected to the region 1 of the main reflector 14 which lies radially substantially further outwardly, which is particularly advantageous for the illumination properties of the lamp of the invention. Thus, the light bundles coming from the light source fall as a whole radially further outwardly onto the main reflector 14 and thus also onto the ring disk 25, which is therefore subjected with a higher light intensity in the radially outwardly lying region 35.

In order to illustrate the special manner by which the light missing because of a cut-away region 0 of the main reflector 14 can be recovered by means of the auxiliary reflector 17, two ray bundles 6, respectively 7 are drawn up by way of example in the drawing. The bundle 6 originates from the light source 13 and is reflected on the region 1 of the main reflector 14 in such a manner that it regularly illuminates the region 15', at the right in FIG. 1, of the site of operation 15. The diametrically opposite region 15'' would be illuminated by the cut-away region 0 of the main reflector 14, which is however omitted in accordance with the invention.

Instead of this, the auxiliary reflector 17 is arranged, inclined and realized in the manner of a concave mirror in such a way that the light bundle 7 issuing therefrom is reflected at the region 1 of the main reflector 14 in such a manner that a ring focus is present approximately in the region 8. Owing to this and in combination with the steeper impinging angle of the light bundle 7 onto the region 1, one obtains that the light reflected by the auxiliary reflector 17 arrives onto the left region 15'' of the site of operation 15 and illuminates the same in a corresponding regular manner, as it is the case in the right region 15'.

It is thus important that the auxiliary reflector 17 causes the light reflected by it to impinge onto the corresponding region, for example 1, not only under an angle somewhat steeper than the light source 13, but that this auxiliary reflector 17 simultaneously bundles the light in such a manner that it lies exactly diametrically opposite (for example 15'') to the region which is directly illuminated by the light source 13 (for example 15').

I claim:

1. Operating theatre lamp comprising;

a housing having a light outlet opening;

a main ring concave reflector mounted to the housing;

a light source centrally arranged in the housing, the light source emitting light towards the main ring concave reflector;

the main reflector being configured to deflect the light from the light source towards the light outlet opening and concentrate the light on a site of operation; and at least one auxiliary ring reflector positioned between the light source and the main reflector and positioned to receive light from the light source which is directed outside of the light rays propagating from the light source to the main reflector and away from the light outlet opening, the at least one auxiliary ring reflector being arranged to deflect the light from the light source back toward the main reflector.

2. Operating theatre lamp according to claim 1, further comprising;

a filter arranged around the light source, the filter having a radius;

the at least one auxiliary reflector being at least partially arranged on the radius.

3. Operating theatre lamp according to claim 1, wherein; the main reflector and the at least one auxiliary reflector are mutually concentric, with the light source at a center.

4. Operating theatre lamp according to claim 1, wherein; a ratio between a distance from the at least one auxiliary reflector to the light source and a distance from the main reflector to the light source lies between 1:2 and 1:6.

5. Operating theatre lamp according to claim 1, wherein: the at least one auxiliary reflector is concave and cooperates with regions of the main reflector which the at least one auxiliary reflector illuminates for a required concentration of the light onto the site of operation.

6. Operating theatre lamp according to claim 1, further comprising:

a filter cylinder supported by the housing by upper and lower fixtures, the filter cylinder being arranged around the light source and being located in a radiation path to the main reflector;

the at least one auxiliary reflector being secured to at least one of said upper and lower fixtures.

7. Operating theatre lamp according to claim 1, wherein:

the main reflector further comprises a lower border region; and the light from the light source which is reflected by the at least one auxiliary reflector is reflected toward the lower border region of the main reflector.

8. Operating theatre lamp according to claim 1, further comprising:

at least one lower auxiliary reflector configured to reflect light from the light source which is directed through the light outlet opening.

9. Operating theatre lamp according to claim 8 wherein: an opening angle defined by a light sector extending from the light source to the at least one lower auxiliary reflector is between 5° and 50°.

10. Operating theatre lamp according to claim 8, wherein: the at least one auxiliary reflector consists of one upper auxiliary reflector and the at least one lower auxiliary reflector consists of one lower auxiliary reflector.

11. Operating theatre lamp according to claim 8, wherein:

the main reflector includes an upper border region; and the at least one lower auxiliary reflector is configured to deflect light from the light source toward the upper border region of the main reflector.

12. Operating theatre lamp according to claim 1, wherein: an opening angle defined by a light sector extending from the light source to the main reflector is greater than an opening angle defined by a light sector extending from the light source to the at least one auxiliary reflector.

13. Operating theatre lamp according to claim 1, wherein: an opening angle defined by a light sector extending from the light source to the main reflector is between 20° and 50°.

14. Operating theatre lamp according to claim 1, wherein: an opening angle defined by a light sector extending from the light source to the at least one auxiliary reflector is between 10° and 40°.

15. Operating theatre lamp according to claim 1, wherein: the at least one auxiliary reflector consists of only one auxiliary reflector.

16. Operating theatre lamp comprising:

a housing having a light outlet opening;

a main ring concave reflector mounted to the housing and having an upper border region and a lower border region;

a light source centrally arranged in the housing, the light source emitting light towards the main ring concave reflector;

the main reflector being configured to deflect the light from the light source towards the light outlet opening; and an upper auxiliary ring reflector positioned to receive light from the light source which is not directed at the main reflector, the upper auxiliary reflector being positioned between the light source and the main reflector and being arranged to deflect the light from the light source substantially toward the lower border region of the main reflector.

17. Operating theatre lamp comprising:

a housing having a light outlet opening;

a main ring concave reflector mounted to the housing;

a light source centrally arranged in the housing, the light source emitting light towards the main ring concave reflector;

the main reflector being configured to deflect the light from the light source towards the light outlet opening and concentrate the light on a site of operation;

an upper auxiliary ring reflector positioned to receive light from the light source which is directed outside the main reflector and away from the light outlet opening, the upper auxiliary reflector being positioned between the light source and the main reflector and being arranged to deflect the light from the light source back toward the main reflector; and a lower auxiliary ring reflector positioned to receive light from the light source which is directed below the lower border region of the main reflector, the lower auxiliary reflector being positioned between the light source and the main reflector and being arranged to deflect the light from the light source back toward the main reflector;

wherein an opening angle defined by a light sector extending from the light source to the main reflector is greater than an opening angle defined by a light sector extending from the light source to the upper auxiliary reflector and greater than an opening angle defined by a light sector extending from the light source to the lower auxiliary reflector.

* * * * *

UNITED STATES PATENT AND TRADEMARK OFFICE

CERTIFICATE OF CORRECTION

PATENT NO. : 5,331,530

DATED : July 19, 1994

INVENTOR(S) : Manfred Scholz

It is certified that error appears in the above-indentified patent and that said Letters Patent is hereby corrected as shown below:

On the Title Page, insert the following information:

--[73] Assignee: Delma elektro-und medizinische Apparatebau Gesellschaft mbH, Tuttlingen, Germany--

Signed and Sealed this

Twenty-eight Day of February, 1995

*Attest:*

*Attesting Officer*

BRUCE LEHMAN

*Commissioner of Patents and Trademarks*